US008250794B2

(12) United States Patent
Hannington

(10) Patent No.: US 8,250,794 B2
(45) Date of Patent: Aug. 28, 2012

(54) EMERGENCY INFORMATION SIGN

(75) Inventor: Michael E. Hannington, Madison, OH (US)

(73) Assignee: Avery Dennison Corporation, Pasadena, CA (US)

( * ) Notice: Subject to any disclaimer, the term of this patent is extended or adjusted under 35 U.S.C. 154(b) by 1978 days.

(21) Appl. No.: 11/054,874

(22) Filed: Feb. 10, 2005

(65) Prior Publication Data

US 2005/0198879 A1 Sep. 15, 2005

Related U.S. Application Data

(60) Provisional application No. 60/552,596, filed on Mar. 12, 2004, provisional application No. 60/621,859, filed on Oct. 25, 2004.

(51) Int. Cl.
*G09F 13/04* (2006.01)

(52) U.S. Cl. ..... 40/570; 40/542; 40/544; 362/34

(58) Field of Classification Search ..... 40/542, 40/543, 544, 553, 570
See application file for complete search history.

(56) References Cited

U.S. PATENT DOCUMENTS

| | | | | |
|---|---|---|---|---|
| 2,000,985 A | | 5/1935 | Quinlan et al. | 240/2.25 |
| 2,745,947 A | | 5/1956 | Sansous | 240/6.4 |
| 3,391,068 A | | 7/1968 | McKay | 204/59 |
| 3,391,069 A | | 7/1968 | McKay | 204/59 |
| 3,539,794 A | | 11/1970 | Rauhut et al. | 240/2.25 |
| 3,557,233 A | | 1/1971 | Zweig | 260/668 |
| 3,576,987 A | | 5/1971 | Voight | 240/2.25 |
| 3,597,362 A | | 8/1971 | Bollyky | 252/186 |
| 3,749,679 A | | 7/1973 | Rauhut | 252/188.3 |
| 3,775,336 A | | 11/1973 | Kasulin et al. | 252/188.3 |
| 3,780,462 A | * | 12/1973 | Pregel et al. | 40/544 |
| 3,808,414 A | | 4/1974 | Roberts | 240/2.25 |
| 3,888,786 A | | 6/1975 | Maulding | 252/188.3 |
| 3,893,938 A | | 7/1975 | Rauhut | 252/188.3 |
| 3,953,761 A | | 4/1976 | Giudice | 315/71 |
| 3,974,368 A | | 8/1976 | Rauhut | 240/2.25 |
| 4,015,111 A | | 3/1977 | Spector | 240/2.25 |
| 4,016,450 A | * | 4/1977 | Balekjian | 315/149 |
| 4,184,193 A | | 1/1980 | Heffernan et al. | 362/34 |
| 4,213,115 A | | 7/1980 | Wetzel | 340/47 |
| 4,420,898 A | * | 12/1983 | Moses | 40/570 |

(Continued)

FOREIGN PATENT DOCUMENTS

CN 2392233 8/2000

(Continued)

OTHER PUBLICATIONS

PCT/US2005/004101; PCT International Search Report mailed Nov. 28, 2005.

(Continued)

*Primary Examiner* — Tashiana Adams
*Assistant Examiner* — Shin Kim
(74) *Attorney, Agent, or Firm* — Avery Dennison Corporation

(57) ABSTRACT

An emergency information sign (10) comprising a base substrate (12) and an indicia layer (14) positioned over the base substrate (12). Exposed areas (24) of the base substrate (12) and covering areas (26) of the indicia layer (14) together form emergency information indicia. The base substrate (12) and the indicia layer (14) each carry phosphorescent materials (20, 22), which absorb and store light from a primary light source (16/18) and emit this stored light during dark conditions.

13 Claims, 4 Drawing Sheets

U.S. PATENT DOCUMENTS

| | | | | |
|---|---|---|---|---|
| 4,456,126 | A | 6/1984 | Hicks, Jr. | 206/573 |
| 4,466,208 | A * | 8/1984 | Logan et al. | 40/544 |
| 4,635,166 | A | 1/1987 | Cameron | 362/34 |
| 4,678,608 | A | 7/1987 | Dugliss | 252/700 |
| 4,715,564 | A | 12/1987 | Kinn et al. | 244/153 |
| 4,745,286 | A | 5/1988 | Jones | 250/459.1 |
| 4,748,546 | A | 5/1988 | Ukrainsky | 362/223 |
| 4,768,136 | A | 8/1988 | Tashjian | 362/84 |
| 4,814,949 | A | 3/1989 | Elliott | 362/34 |
| 4,856,219 | A | 8/1989 | Severance et al. | 43/17.5 |
| 4,903,172 | A | 2/1990 | Schoniger et al. | 362/31 |
| 5,324,202 | A | 6/1994 | Meyers et al. | 434/410 |
| 5,406,463 | A | 4/1995 | Schexnayder, Sr. | 362/34 |
| 5,415,911 | A | 5/1995 | Zampa et al. | 428/40 |
| 5,424,006 | A | 6/1995 | Murayama et al. | 252/301.4 |
| RE35,007 | E | 8/1995 | Cohen et al. | 252/700 |
| 5,564,818 | A | 10/1996 | Grossman et al. | 362/221 |
| 5,654,552 | A | 8/1997 | Toombs | 250/462.1 |
| 5,686,022 | A | 11/1997 | Murayama et al. | 252/351.4 |
| 5,693,394 | A | 12/1997 | Nagai et al. | 428/42.1 |
| 5,695,270 | A | 12/1997 | Collet | 362/34 |
| 5,757,111 | A | 5/1998 | Sato | 313/111 |
| 5,759,671 | A | 6/1998 | Tanaka et al. | 428/166 |
| 5,763,872 | A | 6/1998 | Ness | 250/214 |
| 5,770,111 | A | 6/1998 | Moriyama et al. | 252/301.4 |
| 5,775,016 | A | 7/1998 | Chien | 40/544 |
| 5,833,349 | A | 11/1998 | Apple | 362/84 |
| 5,880,476 | A | 3/1999 | Suzuki | |
| 5,899,009 | A * | 5/1999 | Fisher | 40/542 |
| 5,913,616 | A | 6/1999 | Galella | 40/542 |
| 6,002,000 | A | 12/1999 | Singh et al. | 544/6 |
| 6,065,847 | A | 5/2000 | Palmer et al. | 362/34 |
| 6,069,440 | A | 5/2000 | Shimizu et al. | 313/486 |
| 6,086,795 | A | 7/2000 | Hatton | 252/582 |
| 6,113,150 | A | 9/2000 | Kinberg | 283/94 |
| 6,120,902 | A | 9/2000 | Van Havenbergh et al. | 428/423.1 |
| 6,126,871 | A | 10/2000 | Cranor | 252/700 |
| 6,130,781 | A | 10/2000 | Gauvin | 359/591 |
| 6,143,514 | A | 11/2000 | Ullman et al. | 435/28 |
| 6,164,782 | A | 12/2000 | Pojar | 359/528 |
| 6,166,856 | A | 12/2000 | Araki et al. | 359/627 |
| 6,206,544 | B1 | 3/2001 | Costa | 362/242 |
| 6,235,148 | B1 | 5/2001 | Courson, Jr. et al. | 156/379.6 |
| 6,267,914 | B1 | 7/2001 | Cranor | 252/700 |
| 6,358,563 | B1 | 3/2002 | Van Duynhoven | 427/282 |
| 6,550,929 | B1 | 4/2003 | Dumas | 362/84 |
| 6,656,566 | B1 | 12/2003 | Kuykendall et al. | 428/138 |
| 6,658,773 | B2 | 12/2003 | Rohne et al. | 40/542 |
| 6,663,255 | B1 | 12/2003 | Carito | 362/34 |
| 6,673,437 | B2 | 1/2004 | Kohla et al. | 428/332 |
| 6,690,103 | B1 | 2/2004 | Uke | 313/344 |
| 2001/0047851 | A1 | 12/2001 | Weidenbach | 160/166.1 |
| 2002/0196628 | A1 | 12/2002 | Yoshida et al. | 362/296 |
| 2003/0167669 | A1 | 9/2003 | Rohne et al. | 40/594 |
| 2003/0196251 | A1 | 10/2003 | Lee | 2/244 |
| 2003/0203211 | A1 | 10/2003 | Wei et al. | 428/412 |
| 2004/0150352 | A1 | 8/2004 | Koide et al. | 315/169.3 |
| 2005/0142371 | A1 | 6/2005 | Swain et al. | 428/516 |

FOREIGN PATENT DOCUMENTS

| | | |
|---|---|---|
| CN | 1430011 | 7/2003 |
| EP | 293 348 A1 | 4/1988 |
| EP | 522 785 A2 | 7/1992 |
| EP | 1 031 527 A1 | 2/2000 |
| EP | 989 566 A1 | 3/2000 |
| GB | 2 034 503 | 6/1980 |
| GB | 2 196 461 | 4/1988 |
| JP | 61-26634 | 2/1986 |
| JP | 62-218449 | 9/1987 |
| JP | 08030215 | 2/1996 |
| JP | 2000-214781 | 8/2000 |
| JP | 2002-138278 | 5/2002 |
| JP | 2003-201555 | 7/2003 |
| WO | 92/17800 | 10/1992 |
| WO | 93/14943 | 8/1993 |
| WO | 95/32352 | 11/1995 |
| WO | 98/47026 | 10/1998 |
| WO | 03/022951 | 3/2003 |
| WO | 03/054099 | 7/2003 |

OTHER PUBLICATIONS

PCT/US2005/004150; PCT International Search Report mailed Jun. 23, 2005.

PCT/US2005/004109; PCT International Search Report mailed Jun. 3, 2005.

U.S. Appl. No. 11/054,812, filed Feb. 10, 2005, Hannington.

U.S. Appl. No. 11/055,159, filed Feb. 10, 2005, Hannington.

* cited by examiner

EMERGENCY INFORMATION SIGN

RELATED APPLICATIONS

This application claims priority under 35 U.S.C. §119(e) to U.S. Provisional Patent Application Nos. 60/552,596 and 60/621,859 filed on Mar. 12, 2004 and Oct. 25, 2004, respectively. The entire disclosures of these provisional applications are hereby incorporated by reference.

FIELD OF THE INVENTION

This invention relates generally, as indicated, to an emergency information sign and, more particularly, to an emergency information sign comprising a base substrate and an indicia layer positioned over the base substrate.

BACKGROUND OF THE INVENTION

Phosphorescent material is commonly employed as a passive light source to provide light when a primary source of light (e.g., an electrically powered light source and/or sunlight) is unavailable. When primary light is being supplied to a viewing environment by the primary light source, the phosphorescent material absorbs this primary light and then emits the absorbed light in the absence or minimization of the primary light. Thus, the phosphorescent material can provide light in an emergency situation without batteries and/or on-premise generators being employed. For this reason, phosphorescent material will often be used to make emergency information signs, which must convey emergency indicia (e.g., the word "EXIT" or an arrow pointing in an appropriate escape direction) in dark conditions.

SUMMARY OF THE INVENTION

The present invention provides an emergency information sign which incorporates phosphorescent material in both a base substrate and an indicia layer to clearly convey emergency indicia during dark conditions.

More particularly, the present invention provides an emergency information sign comprising a base substrate and an indicia layer positioned over the base substrate. The base substrate has areas which are exposed and the indicia layer has areas which cover the base substrate, these areas together forming emergency information indicia. The base substrate and the indicia layer each carry phosphorescent materials which absorb and store light from a primary light source and which emit this stored light during dark conditions.

The emission characteristics of the base substrate can differ from those of the indicia layer, whereby the emergency information indicia can be clearly distinguished during dark conditions. This can be accomplished by the emission rate of the base substrate differing from the emission rate of the indicia layer and/or by the emission color of the base substrate differing from the emission color of the indicia layer. Additionally or alternatively, the level of phosphorescent material carried by the base substrate differing from the level of the phosphorescent material carried by the indicia layer.

The indicia layer preferably has a high optical transmittance (e.g., at least 50%, at least 60%, at least 70%, and/or at least 80%). The base substrate can have an optical transmittance less than that of the indicia layer, and the sign can be "front-lit" with primary light passing through the indicia layer to the base substrate. Alternatively, the base substrate can have an optical transmittance the same or greater than that of the indicia layer, and the sign can be "back-lit" with primary light passing through the base substrate to the indica layer.

The exposed areas of the base substrate can form emergency information indicia and, if so, the indicia layer may be made by positioning a matrix from a die-cut sheet on the base substrate. The covering areas of the indicia layer can instead form the emergency information indicia and, if so, the indicia layer may be made by positioning die-cut indicia on the base substrate. Alternatively, the indicia can be printed or painted (with a mask) onto the base substrate.

These and other features of the invention are fully described and particularly pointed out in the claims. The following description and drawings set forth in detail certain illustrative embodiments of the invention, which are indicative of but a few of the various ways in which the principles of the invention may be employed.

DRAWINGS

DETAILED DESCRIPTION

Figure 1:
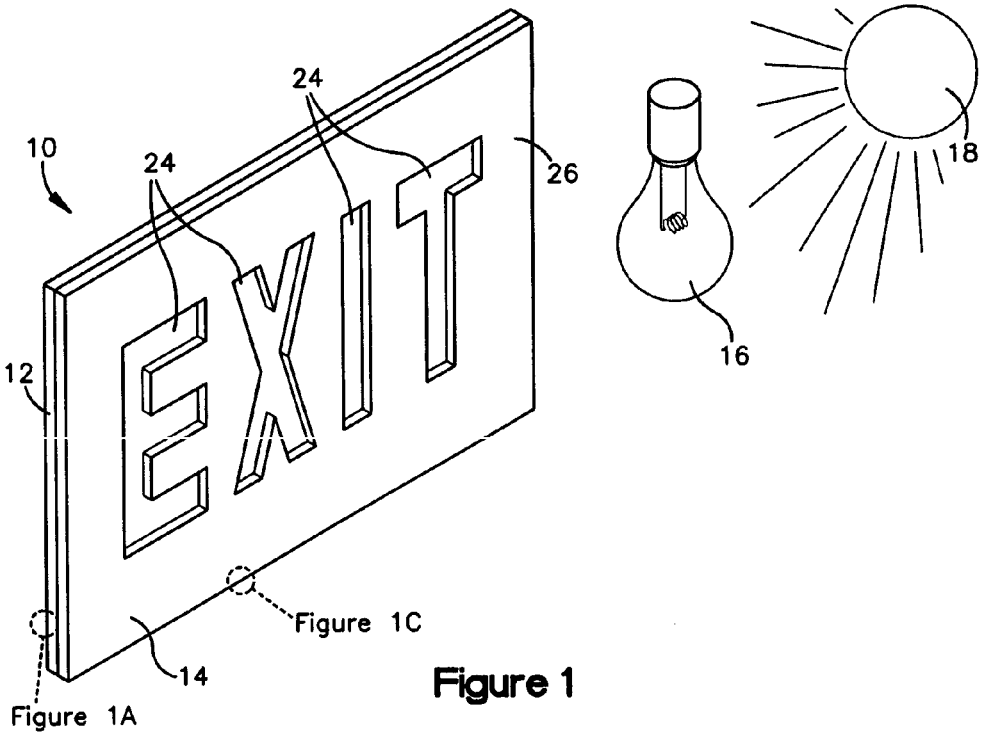
FIG. 1 is a perspective view of an emergency information sign according to the present invention.

Referring now to the drawings, and initially to FIG. 1, an emergency information sign 10 according to the present invention is shown. The sign 10 comprises a base substrate 12 and an indicia layer 14 positioned over the base substrate 12. The sign 10 is oriented so that the indicia layer 14 is closest to a primary light source, which can be either an artificial light source 16 and/or an ambient light source 18.

Figures 1A, 1B, 1C, 1D:
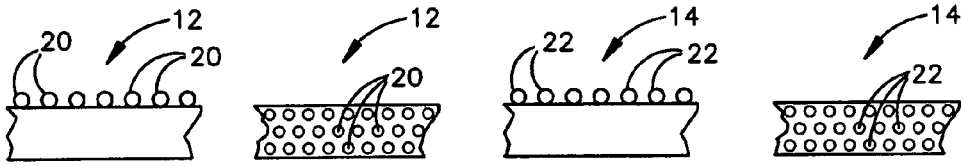
FIG. 1A is a close-up view of the base substrate of the emergency information sign of FIG. 1.
FIG. 1B is a close-up view of a modified base substrate of the emergency information sign of FIG. 1.
FIG. 1C is a close-up view of the indicia layer of the emergency information sign of FIG. 1.
FIG. 1D is a close-up view of a modified indicia layer of the emergency information sign of FIG. 1.

The base substrate 12 carries a phosphorescent material 20 that may be in the form of particles coated thereover (FIG. 1A) or embedded therein (FIG. 1B). It may be noted that, although in the illustrated embodiment the base substrate has a sheet-like shape, other structures are certainly possible. Specifically, for example, the base substrate 12 could comprise a portion of a wall or floor over which the indicia layer 14 is placed. Accordingly, the substrate could be made of a variety of materials, provided that the substrate material is compatible with coating, embedding, or otherwise carrying the phosphorescent material 20.

The indicia layer 14 carries a phosphorescent material 22 that may be in the form of particles coated thereover (FIG. 1C) or embedded therein (FIG. 1D). In the sign 10 shown in FIG. 1, the indicia layer 14 can be made from a clear polymer (Polycarbonate, PMMA, Urethane, Vinyl, etc.). The density of the phosphorescent material 22 in the layer 14 is such that it has a relatively high optical transmission, such as at least 50%, at least 60%, at least 70%, and/or at least 80%. (Optical transmittance refers to the ratio of the light transmitted by the primary light source to the light which passes through the phosphorescent-carrying substrate. An optical transmittance of 0% would correspond to a substrate which allows no optical transmission and an optical transmittance of 100% would correspond to a substrate which is completely transparent.)

Figure 2:
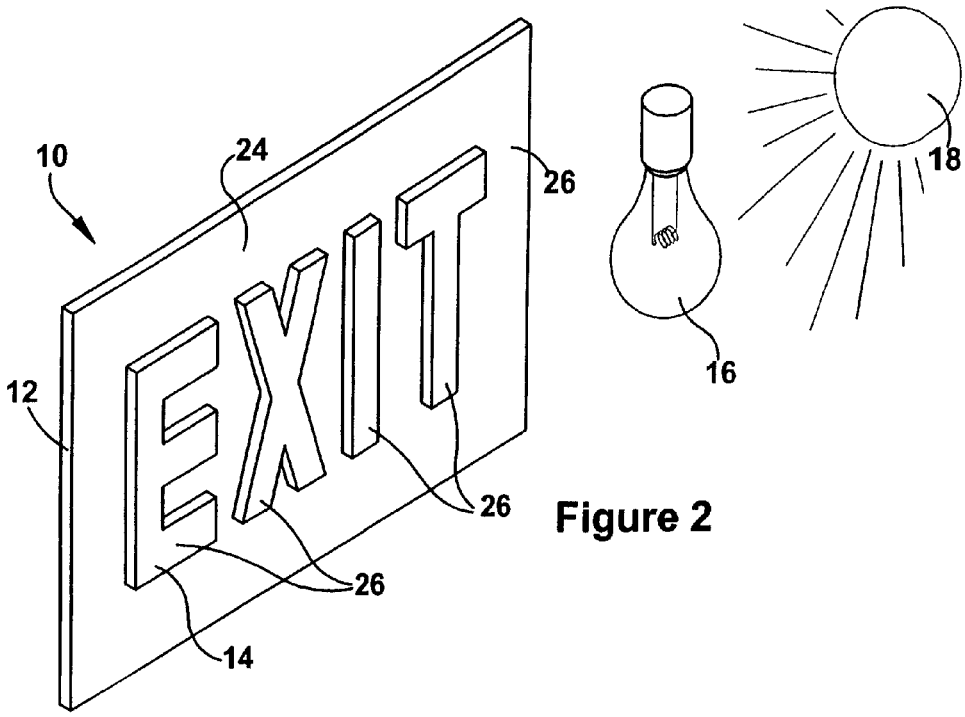
FIG. 2 is a perspective view of another emergency information sign according to the present invention.

The base substrate 12 has exposed areas 24 that are not covered by the indicia layer 14, and the indicia layer 14 has areas 26 which cover aligned areas of the base substrate 12. The areas 24 and the areas 26 together form the emergency information indicia which, in the illustrated embodiment, is the word "EXIT." In the emergency information sign 10 shown in FIG. 1A, the areas 24 form the letters E-X-I-T, and the areas 26 form the background for these letters. Alternatively, as shown in FIG. 2, the exposed areas 24 of the base substrate 12 can form the background, and the areas 26 of the indicia layer 14 can form the letters E-X-I-T.

When primary light is emitted from the primary light source 16/18, it passes to the areas 24 of the indicia layer 14 and is absorbed and stored by the phosphorescent material 22 therein. Also, because the indicia layer 14 has a high optical transmission, the primary light also passes to the aligned areas of the base substrate 12 and is absorbed/stored by the phosphorescent material 20 therein. Further, the primary light passes to the exposed areas 26 of the base substrate 12 and is absorbed and stored by the phosphorescent material 20 therein.

Figure 3:
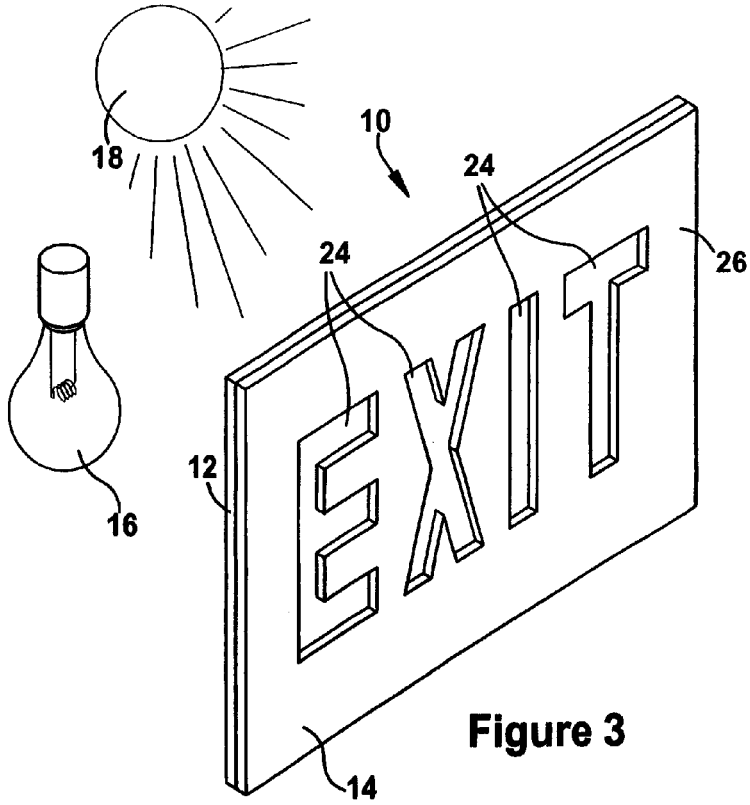
FIG. 3 is a perspective view of another emergency information sign according to the present invention.
Figure 4:
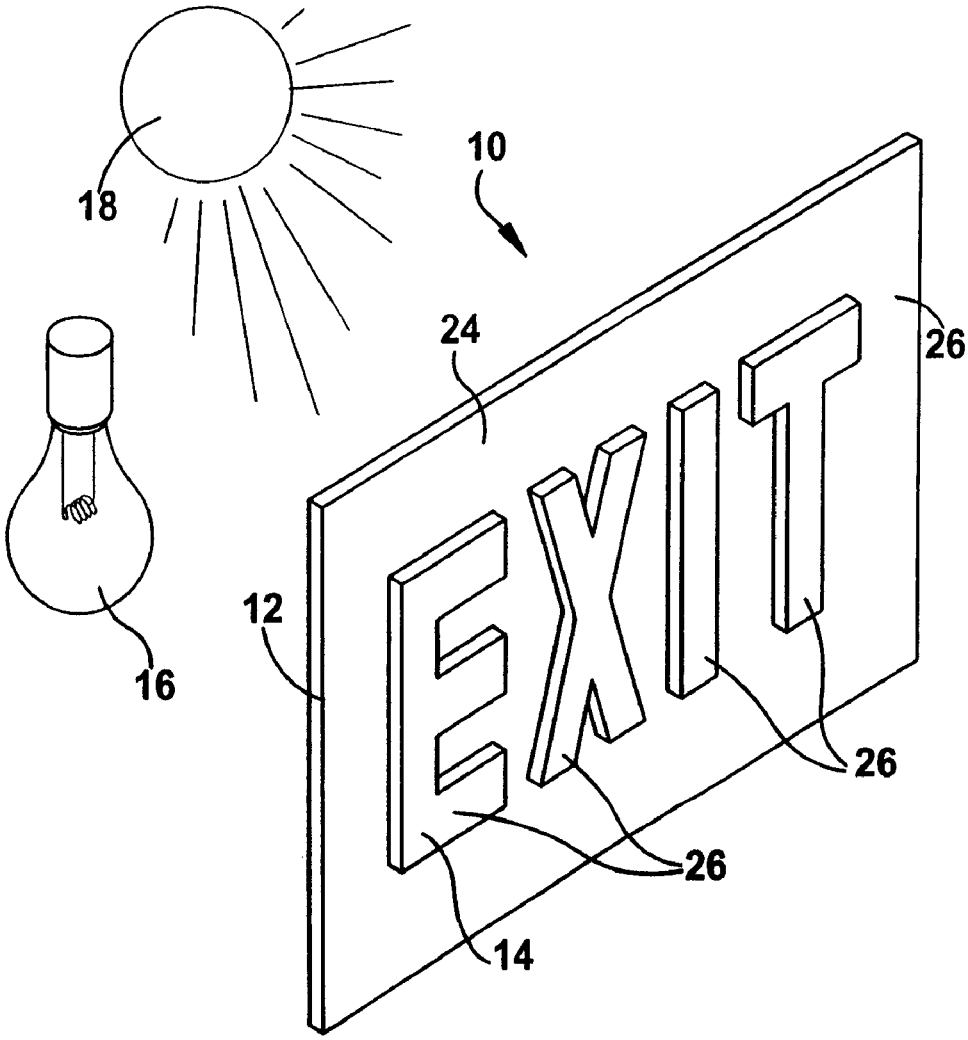
FIG. 4 is a perspective view of another emergency information sign according to the present invention.

Referring now to FIGS. 3 and 4, other emergency information signs 10 according to the present invention are shown. In these signs, the base substrate 12 is closest to the primary light source 16/18, and both the base substrate 12 and the indicia layer 14 have a relatively high optical transmission, such as at least 50%, at least 60%, at least 70%, and/or at least 80%. When primary light is emitted from the primary light source 16/18, it passes to the base substrate 12 and is absorbed/stored by the phosphorescent material 20 therein. The primary light also passes therethrough to the indicia layer 14, whereat it is absorbed/stored by the phosphorescent material 22 therein. In FIG. 3, the areas 24 form the letters E-X-I-T, and the areas 26 form the background for these letters. In FIG. 4, the exposed areas 24 of the base substrate 12 form the background, and the areas 26 of the indicia layer 14 form the letters E-X-I-T.

In the absence of primary light (i.e., in dark conditions), the phosphorescent material 20/22 emits the stored light as phosphors, thereby providing passive light. If the emission characteristics of the base substrate 12 and the indicia layer 14 are substantially the same, the areas 24 will appear brighter than the areas 26 because of the "double layer" of emission. (The high optical transmission of the indicia layer 14 allows the passive light created by underlying areas of the base substrate 12 to pass therethrough to the viewing environment.) If the emission characteristics of the base substrate 12 differ from the emission characteristics of the indicia layer 14, the emergency information indicia can be clearly distinguished during dark conditions. For example, the emission characteristics can be different emission levels and/or different emission colors. Additionally or alternatively, the level of phosphorescent material 20 carried by the base substrate 12 can differ from the level of the phosphorescent material 22 carried by the Indicia layer 14.

The overall passive light emission of the emergency information sign 10 (or the combined passive light emission of the base substrate 12 and the indicia layer 14) can be at least 15.0 mcd/m$^2$ at ten minutes and at least 2 mcd/m$^2$ at sixty minutes, and/or can be an emission of at least 20.0 mcd/m$^2$ at ten minutes and at least 2.8 mcd/m$^2$ at sixty minutes. These emission levels are necessary to satisfy IMO and ASTM standards, respectively, for emergency lighting requirements. The sign 10 can have an emission of at least 30 mcd/m$^2$ at ten minutes, at least 40 mcd/m$^2$ at ten minutes, and/or at least 50 mcd/m$^2$ at ten minutes.

The phosphorescent material 20/24 can be a phosphorescent phosphor including a matrix expressed by $MAI_2O_4$ in which M is calcium, strontium, or barium, or in which M is magnesium activated by calcium, strontium, barium, and/or europium. These phosphorescent phosphors show excellent photo-resistance and possess extremely long afterglow characteristics. Such phosphorescent phosphors are disclosed and described in U.S. Pat. No. 5,424,006, the entire disclosure of which is hereby incorporated by reference. Another phosphor having intense and persistent afterglow characteristics is disclosed in U.S. Pat. No. 5,770,111, the entire disclosure of which is also hereby incorporated by reference. By using intense and/or persistent phosphors, a low density of particles can be used. This may prove to be especially useful when the base substrate 12 and/or the indicia layer 14 need to have a high optical transmission, but a high emission rate is also desired.

Figure 5A:
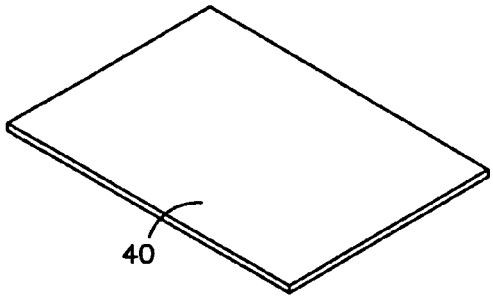
FIGS. 5A-5D are views schematically showing a method of making an emergency information sign according to the present invention.
Figure 5B:
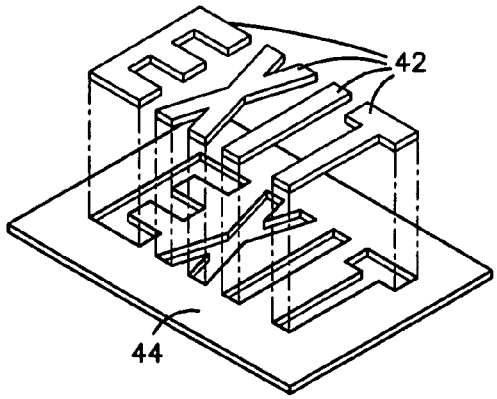
Figure 5C:
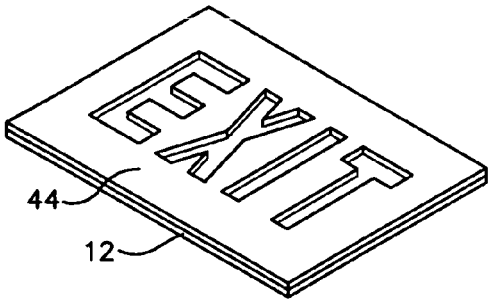
Figure 5D:
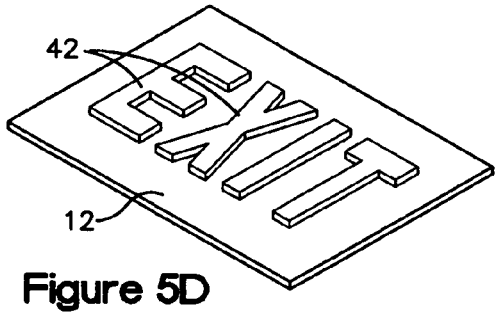

The emergency information sign 10 can be made by the process shown schematically in FIGS. 5A-5D. Specifically, a sheet 40 is provided having the desired emission and transmission characteristics of the indicia layer 14. (FIG. 5A.) The emergency information is die cut from the sheet 40 to form cut portions 42 and a matrix 44. (FIG. 5B.) For the emergency information signs 10 shown in FIGS. 1 and 3, the cut portions 42 are discarded and the matrix 44 is placed on the substrate 12. (FIG. 5C.) For the emergency signs 10 shown in FIGS. 2 and 4, the matrix 44 is discarded and the cut portions 42 are placed on the base substrate 12. (FIG. 5D.) A clear adhesive can be used to secure the indicia layer items 42/44 to the base substrate 12.

Figure 6:
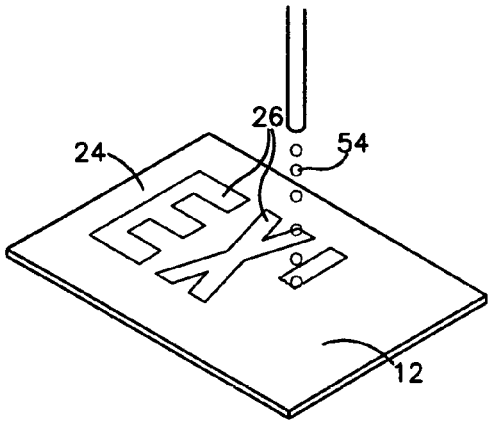
FIG. 6 is a view schematically showing another method of making an emergency information sign according to the present invention.
Figure 7:
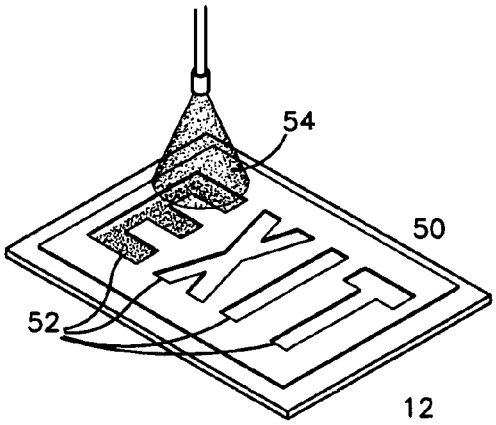
FIG. 7 is a view schematically showing another method of making an emergency information sign according to the present invention.

As shown in FIG. 6, the emergency signs 10 of FIGS. 2 and 4 can also be made by printing the areas 26 onto the base substrate 12. Alternatively, as shown in FIG. 7, a mask 50 having openings 52 corresponding to the areas 26 could be placed on the base substrate 12 and then be spray painted to form the areas 26. A compound 54 having the desired emission, transmission, and other characteristics of the indicia layer 14 would be used as the printing and/or painting fluid.

One may now appreciate that the present invention provides an emergency information sign 10 which incorporates phosphorescent material 20/22 in both a base substrate 12 and an indicia layer 14 to clearly convey emergency indicia during dark conditions. Although the invention has been shown and described with respect to certain preferred embodiments, it is evident that equivalent and obvious alterations and modifications will occur to others skilled in the art upon the reading and understanding of this specification. The present invention includes all such alterations and modifications and is limited only by the scope of the following claims.

The invention claimed is:

1. An emergency information sign comprising a base substrate and an indicia layer positioned over the base substrate;

wherein the base substrate has areas which are exposed and the indicia layer has areas which cover the base substrate, these areas together forming emergency information indicia;

wherein the base substrate and the indicia layer each carry phosphorescent materials which absorb and store light from a primary light source and emit this stored light during dark conditions; and the base substrate has an optical transmittance less than that of the indicia layer, and wherein primary light from the primary light source passes through the indicia layer to the base substrate.

2. An emergency information sign as set forth in claim 1, wherein emission characteristics of the base substrate differ from emission characteristics of the indicia layer, whereby emergency information indicia can be clearly distinguished during dark conditions.

3. An emergency information sign as set forth in claim 2, wherein emission rate of the base substrate differs from emission rate of the indicia layer.

4. An emergency information sign as set forth in claim 3, wherein emission color of the base substrate differs from emission color of the indicia layer.

5. An emergency information sign as set forth in claim 2, wherein emission color of the base substrate differs from emission color of the indicia layer.

6. An emergency information sign as set forth in claim 2, wherein the level of phosphorescent material carried by the base substrate differs from the level of the phosphorescent material carried by the indicia layer.

7. An emergency information sign as set forth in claim 1, wherein the indicia layer has an optical transmittance of at least 50%.

8. An emergency information sign as set forth in claim 1, wherein the phosphorescent material is coated on the base substrate.

9. An emergency information sign as set forth in claim 1, wherein the phosphorescent material is embedded in the base substrate.

10. An emergency information sign as set forth in claim 1, wherein the phosphorescent material is coated on the indicia layer.

11. An emergency information sign as set forth in claim 1, wherein the phosphorescent material is embedded in the indicia layer.

12. An emergency information sign as set forth in claim 1, wherein the combined passive light emission of the base substrate and the indicia layer is at least 15.0 mcd/$m^2$ at ten minutes and at least 2 mcd/$m^2$ at sixty minutes.

13. An emergency information sign as set forth in claim 1, wherein the combined passive light emission of the base substrate and the indicia layer is at least 20.0 mcd/$m^2$at ten minutes and at least 2.8 mcd/$m^2$ at sixty minutes.

* * * * *